US005744069A

United States Patent [19]

Maeda et al.

[11] Patent Number: 5,744,069

[45] Date of Patent: Apr. 28, 1998

[54] WATER SOLUABLE METAL ANTICORROSIVE

[75] Inventors: Akio Maeda, Hikari; Makoto Kanekiyo, Kumage County, both of Japan

[73] Assignee: Chiyoda Chemical Kabushiki Kaisha, Yamaguchi, Japan

[21] Appl. No.: 339,816

[22] Filed: Nov. 15, 1994

[30] Foreign Application Priority Data

Nov. 24, 1993 [JP] Japan ..... 5-293571

[51] Int. Cl.[6] ..... C09K 11/14

[52] U.S. Cl. ..... 252/394; 252/77; 252/78.1; 252/79; 252/389.61; 252/389.62; 252/395

[58] Field of Search ..... 422/16; 252/77, 252/78.1, 68, 79, 390, 394, 389.61, 389.62, 395, 50, 49.6

[56] References Cited

U.S. PATENT DOCUMENTS

| | | | |
|---|---|---|---|
| 3,778,376 | 12/1973 | Herber | 252/77 |
| 4,285,823 | 8/1981 | Sung et al. | 252/50 |
| 4,294,585 | 10/1981 | Sung | 44/343 |
| 4,392,968 | 7/1983 | Ishida et al. | 252/51.5 R |
| 4,758,363 | 7/1988 | Sung et al. | 252/51.5 R |
| 4,873,139 | 10/1989 | Kinosky | 428/419 X |
| 4,981,493 | 1/1991 | Sung | 44/331 |
| 5,141,675 | 8/1992 | Vanderpool et al. | 252/389.23 |
| 5,156,769 | 10/1992 | Cha et al. | 252/395 |
| 5,171,462 | 12/1992 | DeRosa et al. | 252/47 |
| 5,174,915 | 12/1992 | Hutchison et al. | 252/50 |
| 5,217,686 | 6/1993 | Vanderpool et al. | 422/16 |
| 5,236,626 | 8/1993 | Vanderpool et al. | 252/394 |

OTHER PUBLICATIONS

RO 69036 (1971) as Abstracted by Chemical Abstract 95:47253.

Zashch. Met. (1991) vol. 27, No. 5, pp. 760–766 as Abstracted by Chemical Abstract 115:242453.

BE 893807 (1983) as abstracted by Chemical Abstract 98:184222, Hawley's Condensed Chemical Dictionary, 11th ed., Sax et al. (1987) p. 335.

Perry, Robert H., *Perry's Chemical Engineers' Handbook Sixth Edition*, McGraw–Hill Book Company, pp. 23–28, (1984).

*Primary Examiner*—Sharon Gibson
*Assistant Examiner*—Valerie Fee
*Attorney, Agent, or Firm*—Olson & Hierl, Ltd.

[57] ABSTRACT

A water soluble metal anticorrosive comprising a tetrazole compound or a water soluble salt thereof represented by the following formula (1):

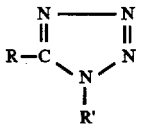

wherein R and R' each indicate hydrogen, an alkyl group having 1 to 20 carbon atoms, a cycloalkyl group, a phenyl group, an alkylphenyl group, an amino group, a mercapto group or an alkylmercapto group).

7 Claims, No Drawings

WATER SOLUABLE METAL ANTICORROSIVE

BACKGROUND OF THE INVENTION

1. Field of the Invention

The present invention relates to a metal anticorrosive agent. More specifically, the present invention relates to a water soluble metal anticorrosive agent comprising certain tetrazole compounds or a water soluble salt thereof, and various metal treating compositions containing the water soluble metal anticorrosive agents.

2. Description of the Related Art

Component mixtures containing nitrites such as sodium nitride, and alkanolamines such as triethanolamine, and amine salts of p-t-butylbenzoate were previously long used as water soluble metal anticorrosives for ferrous metals. However, although boric acid amine salts, carboxylic acid amine salts and dibasic acid amine salts are used in place of the above anticorrosives from the viewpoint of overcoming the problems of carcinogenesis and safety and health, these compounds are still unsatisfactory in respect to rustproofing abilities and cost. Furthermore in recent years, environmental problems, particularly, problems with respect to waste water treatment, have arisen.

On the other hand, although triazoles such as benzotriazole and imidazoles are used for preventing eluation of non-ferrous metals such as copper and copper alloys, and cobalt ions of super-hard alloys, these compounds are also unsatisfactory in respect to rustproofing abilities.

The boric acid amine salts, carboxylic acid amine salts and dibasic acid amine salts, which are currently used, are required in high concentrations in order to exhibit rustproofing abilities. This is troublesome in respect to the recent environmental problems, particularly in regards to load in waste water treatment.

SUMMARY OF THE INVENTION

As a result of intensive research performed by the inventors for solving the problems of conventional anticorrosives, the inventors discovered a water soluble metal anticorrosive agent having excellent anticorrosive abilities for not only ferrous metals but also non-ferrous metals such as copper, copper alloys and super-hard alloys, and having stable effects in low concentrations.

The present invention relates to a water soluble anticorrosive agent and various metal treating compositions containing a water soluble metal anticorrosive agent comprising a tetrazole compound or a water soluble salt thereof represented by the following formula (1):

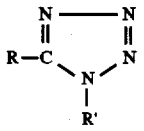

(wherein R and R' each indicate hydrogen, an alkyl group having 1 to 20 carbon atoms, a cycloalkyl group, a phenyl group, an alkylphenyl group, an amino group, a mercapto group or an alkylmercapto group).

The water soluble metal anticorrosive agents of the present invention have excellent rustproofing abilities and exhibit stable effects at a low concentration. The anticorrosive agent is thus economical and allows better treatment of environmental problems, particularly, when used in attempts to decrease the load in water waste treatment.

DETAILED DESCRIPTION OF THE INVENTION

The detail of the present invention is further described below.

Examples of the tetrazole compounds represented by formula (1) include 1H-tetrazole, 5-amino-1H-tetrazole, 5-methyl-1H-tetrazole, 1-methyl-5-ethyl-tetrazole, 1-methyl-5-mercapto-tetrazole, 5(2-aminophenyl)-1H-tetrazole, 1-cyclohexyl-5-mercapto-tetrazole, 1-phenyl-5-mercapto-tetrazole, 1- carboxymethyl-5-mercapto-tetrazole, 5-phenyl-1H-tetrazole and the like.

The water soluble metal anticorrosive agent of the present invention includes a water soluble salt of a tetrazole of formula (1). The term water soluble salt of a tetrazole of formula (1) here refers to any inorganic and organic salt having a solubility of at least 0.001% by weight, preferably at least 0.01% by weight, in water at room temperature.

The water soluble salt of a tetrazole compound of formula (1) can be produced by a known method using an organic nitrogen-containing compound, ammonia and an inorganic salt. Examples of inorganic salts suitable for producing the water soluble salts include oxides, hydroxides or carbonates of alkali metals such as sodium, potassium, lithium, etc., and also alkali earth metals such as barium, calcium, etc.

Examples of organic nitrogen-containing compounds include monoamines such as monoalkylamine, dialkylamine, trialkylamine, monocyclohexylamine, dicyclohexylamine and the like; diamines substituted by 1 to 4 alkyl groups, and alkylmonoamines and alkyldiamines having alkyl groups at least one of which has a hydrophilic group such as a hydroxyl group or polyoxyethylene group. Of these amines, it is particularly advantageous to use monoethanolamine, diethanolamine, triethanolamine, dimethyl-ethanolamine, diethylethanolamine, monomethylethanolamine, monoethylethanolamine or monobutylethanolamine.

The metal anticorrosive agent is added at a concentration of 0.01 to 20% by weight, preferably 0.01 to 5% by weight, in the object system. Although the metal anticorrosive of the present invention can be used alone, it can also be used together with various general additives such as carboxylic acids, dibasic acids, triazoles, imidazoles, thiazoles, surfactants, mineral oil, extreme-pressure additives, inorganic salts, defoaming agents and preservatives. Examples of various carboxylic acids and dibasic acids include caprylic acid, capric acid, lauric acid, oleic acid, stearic acid, behenic acid, adipic acid, sebacic acid, dodecanoic diacid, C22 diacid. Examples of triazoles, imidazoles and thiazoles include benzotriazole, tolyltriazole, benzoimidazole, mercaptobenzothiazole, dimercaptothiadiazole and the like. Examples of surfactants include anionic surfactants such as fatty amine soap and petroleum sulfonate, nonionic surfactants such as polyhydroxy alcohol fatty acid esters (sorbitan fatty acid esters, polyoxyethylene sorbitan fatty acid esters, polyglycerin fatty acid esters, propylene glycol fatty acid esters, polyoxyethylene glycol fatty acid esters, and the like); polyoxyethylene alkyl ethers, polyoxyethylene alkyl phenyl ethers, long-chain alkyl sulfates, synthetic sulfonates, petroleum sulfonates, fatty acid alkylolamide and the like. Examples of mineral oil include spindle oil, machine oil, cylinder oil, turbine oil and the like. Examples of extreme-pressure additives include chlorinated extreme-pressure additives such as chlorinated paraffin, chlorinated diphenyl, chlorinated fatty acids, chlorinated fatty oils and the like; sulfur-containing extreme-pressure additives such as sulfurized fats and oils, sulfurized olefins, dibenzyldisulfide, dodecyldisulfide, diphenyldisulfide, saturated fatty acid sulfides, dialkyldithiocarbamic acid-metal compounds and the like; and phosphorus-containing extreme-pressure additives such as phosphites, phosphates and the like. Examples of inorganic salts include phosphates, borates and the like.

Methods of the present invention are illustrated with reference to the following examples, but the invention is not intended to be limited only thereto. In the examples, "%" is "% by weight" unless otherwise provided.

The water soluble metal anticorrosives of the present invention used in the examples are shown in Table 1, and the anticorrosives used as comparative examples are shown in Table 2.

EXAMPLE 1 AND COMPARATIVE EXAMPLE 1

0.1% each of the water soluble amine salts of tetrazole compounds (1 to 25) of the present invention, and 2.0% each of boric acid amine salts, carboxylic acid amine salts and dibasic acid amine salts (1 to 9) of Comparative Examples were respectively used in tests by a cast iron cuttings dip method, a cast iron specimen semi-dip method, a steel plate full dip testing method and a steel plate surface treatment test. The results obtained are shown in Table 2. The operation of each of the methods is as follows:

(Cast iron cuttings dip method)

Cast iron cuttings (FC-20) of constant mesh obtained by dry cutting were degreased and washed, and then placed in glass Petri dish. A test solution was poured into the Petri dish, the cuttings were left submerged in the solution for a predetermined time, and then the test solution was removed by tilting the Petri dish. The Petri dish was covered, and left to stand at room temperature for 24 hours. The rusting state was then observed.

(Cast iron specimen semi-dip method)

A cast iron plate (FC-20, 3×25×60 mm) was placed in a glass container, and a test solution was poured into the container. The plate was then left to stand in a semi-dip state at 40° C. for 24 hours. The rusting states in the solution, the gas phase portion and the boundary therebetween were observed.

(Steel plate full dip method)

A steel plate (SPCC-SB, 1×25×60 mm) which was polished, degreased and washed by conventional methods was dipped in a test solution, and then left to stand at 40° C. for 168 hours. The rusting state of the specimen was observed.

(Steel plate surface treatment method)

A steel plate (SPCC-SB, 1×60×80 mm) which was polished, degreased and washed by conventional methods was dipped in a test solution for 3 seconds, and subjected to a humidity test at 40° C. and a relative humidity of 95% for 96 hours. The rusting state of the specimen was observed.

In these tests, the results were judged on the basis of the following criteria:

(Criteria for cast iron specimen semi-dip method)

◎ . . . no rusting
○ . . . slight spot rusting
Δ . . . spot rusting
x . . . rusting
x x . . . significant rusting (Criteria for steel plate surface treatment test method (JIS K2246))

A grade . . . Average rusting degree of 0
B grade . . . Average rusting degrees of 1 to 10
C grade . . . Average rusting degrees of 11 to 25
D grade . . . Average rusting degrees of 26 to 50
E grade . . . Average rusting degrees of 51 to 100

EXAMPLES 2 AND 3 AND COMPARATIVE EXAMPLES 2 and 3

Each of the water soluble anticorrosives of the present invention and the anticorrosives of the Comparative Examples of the types shown in Tables 5 and 7, respectively, was added in the amount shown in the tables to the experimental amine type antifreezing solution having the composition shown in Table 4 and the experimental non-amine type antifreezing solution having the composition shown in Table 6. Each of the resultant mixtures was subjected to the metal corrosion test of an antifreezing solution provided in JIS K 2234 (at 88°±2° C. for 3336 hours). The results obtained are shown in Tables 5 and 7.

EXAMPLE 4 AND COMPARATIVE EXAMPLE 4

The tetrazole compound water soluble amine salts of the present invention, and benzotriazole amine salts and tolyltriazole amine salts of the Comparative Examples,were tested with respect to the rustproofing effects on a steel plate having treated surfaces. The operation method was as follows: A steel plate (C1100P, 0.5×60×80 mm) which was polished, degreased and washed by conventional methods was dipped in each of test solutions respectively containing 0.03% of the compounds (1 to 25) of the present invention and test solutions respectively containing 0.2% of the compounds (10 to 17) of Comparative Examples for 3 seconds. After air drying, the steel plate was left to stand at 40° C. and a relative humidity of 95% for 168 hours, and the discoloration state of the specimen was observed. The results obtained are shown in Table 8.

EXAMPLE 5 AND COMPARATIVE EXAMPLE 5

The tetrazole compound water soluble amine salts of the present invention, and benzotriazole amine salts and tolyltriazole amine salts of the Comparative Examples were tested with respect to the effect of preventing eluation of cobalt ions. The operation method was as follows: A 3% aqueous solution of the experimental sample described below was first prepared, and 0.03% each of the compounds of the present invention (1 to 25) and 0.2% each of the compounds of the Comparative Examples (10 to 17) were respectively added to the solution to form test solutions. 5 g of metal cobalt powder were added to 100 ml of test solution and shaken at 40° C. for 96 hours, and the test solution was then filtered by using a No. 5A filter. The outer appearance of the filtrate was observed, and the cobalt ion concentration was measured. The cobalt ion concentration was measured by an atomic absorption method. The results obtained are shown in Table 9.

| Components of experimental sample | Compounding amount |
|---|---|
| Sebacic acid | 10 (wt/wt %) |
| Boric acid | 10 |
| Diethanolamine | 17 |
| Triethanolamine | 13 |
| Water | 50 |

TABLE 1

| No. | Water soluble metal anticorrosives of the present invention used in Experiments |
|---|---|
| 1 | 1H-tetrazole-monoethanolamine |
| 2 | 5-amino-1H-tetrazole-diethanolamine |
| 3 | 5-methyl-1H-tetrazole-triethanolamine |
| 4 | 1-methyl-5-ethyl-tetrazole-dimethylethanolamine |
| 5 | 1-methyl-5-mercapto-tetrazole-diethylethanolamine |
| 6 | 5(2-aminophenyl)-1H-tetrazole-monomethylethanolamine |
| 7 | 1-cyclohexyl-5-mercapto-tetrazole-monoethylethanolamine |
| 8 | 1-phenyl-5-mercapto-tetrazole-monobuthylethanolamine |
| 9 | 1-carboxymethyl-5-mercapto-tetrazole-diethanolamine |
| 10 | 5-amino-1H-tetrazole-triethanolamine |
| 11 | 5-amino-1H-tetrazole-dimethylethanolamine |
| 12 | 5-amino-1H-tetrazole-diethylethanolamine |
| 13 | 5-amino-1H-tetrazole-monomethylethanolamine |
| 14 | 5-amino-1H-tetrazole-monoethylethanolamine |
| 15 | 5-amino-1H-tetrazole-monobutylethanolamine |
| 16 | 5-amino-1H-tetrazole-sodium salt |
| 17 | 5-amino-1H-tetrazole-potassium salt |
| 18 | 1H-tetrazole-sodium salt |
| 19 | 5-methyl-1H-tetrazole-potassium salt |
| 20 | 1-methyl-5-ethyl-tetrazole-sodium salt |
| 21 | 1-methyl-5-mercapto-tetrazole-potassium salt |
| 22 | 5(2-aminophenyl-1H-tetrazole-potassium salt |
| 23 | 1-cyclohexyl-5-mercapto-tetrazole-potasium salt |
| 24 | 1-phenyl-5-mercapto-tetrazole-potassium salt |
| 25 | 1-carboxymethyl-5-mercapto-tetrazole-potassium salt |

TABLE 2

| No. | Water soluble metal anticorrosives used in Comparative Experiments |
|---|---|
| 1 | boric acid-diethanolamine |
| 2 | boric acid-sodium salt |
| 3 | caprylic acid-diethanolamine |
| 4 | lauric acid-potassium salt |
| 5 | oleic acid-diethanolamine |
| 6 | sebacic acid-diethanolamine |
| 7 | sebacic acid-potassium salt |
| 8 | dodecanoic diacid-diethanolamine |
| 9 | dodecanoic diacid-diethylaminoethanolamine |
| 10 | benzotriazole-diethanolamine |
| 11 | benzotriazole-triethanolamine |
| 12 | tolyltriazole-diethanolamine |
| 13 | tolyltriazole-diethanolamine |
| 14 | benzotriazole-potassium salt |
| 15 | benzotriazole-sodium salt |
| 16 | tolyltriazole-potassium salt |
| 17 | tolyltriazole-sodium salt |

TABLE 3

| | cast iron cuttings | cast iron cuttings semi-dip test | | | steel plate | steel plate surface |
|---|---|---|---|---|---|---|
| | dip test rusting rate (%) | liquid phase | liquid level | gas phase | full dip test | treatment test (grade) |
| present invention No. | | | | | | |
| 1 | no-rusting | ◎ | ◎ | ◎ | no-rusting | A |
| 2 | " | ◎ | ◎ | ◎ | " | A |
| 3 | " | ◎ | ◎ | ◎ | " | A |
| 4 | " | ◎ | ◎ | ◎ | " | A |
| 5 | " | ◎ | ◎ | ◎ | " | A |
| 6 | " | ◎ | ◎ | ◎ | " | A |
| 7 | " | ◎ | ◎ | ◎ | " | A |
| 8 | " | ◎ | ◎ | ◎ | " | A |
| 9 | " | ◎ | ◎ | ◎ | " | A |
| 10 | " | ◎ | ◎ | ◎ | " | A |

TABLE 3-continued

| | cast iron cuttings | cast iron cuttings semi-dip test | | | steel plate | steel plate surface |
|---|---|---|---|---|---|---|
| | dip test rusting rate (%) | liquid phase | liquid level | gas phase | full dip test | treatment test (grade) |
| 11 | " | ◎ | ◎ | ◎ | " | A |
| 12 | " | ◎ | ◎ | ◎ | " | A |
| 13 | " | ◎ | ◎ | ◎ | " | A |
| 14 | " | ◎ | ◎ | ◎ | " | A |
| 15 | " | ◎ | ◎ | ◎ | " | A |
| 16 | 5% rusting | ◎ | ◎ | ○ | " | B |
| 17 | " | ◎ | ◎ | ○ | " | B |
| 18 | 10% rusting | ◎ | ◎ | Δ | " | B |
| 19 | " | ◎ | ◎ | Δ | " | B |
| 20 | " | ◎ | ◎ | Δ | " | B |
| 21 | " | ◎ | ◎ | Δ | " | B |
| 22 | 5% rusting | ◎ | ◎ | Δ | " | B |
| 23 | " | ◎ | ◎ | Δ | " | B |
| 24 | " | ◎ | ◎ | Δ | " | B |
| 25 | " | ◎ | ◎ | Δ | " | B |
| comparative No. | | | | | | |
| 1 | 10% rusting | ◎ | Δ | X | a sign of rusting | C |
| 2 | ≧80% rusting | Δ | X | XX | spot rusting | D |
| 3 | 50% rusting | Δ | X | X | spot rusting | C |
| 4 | ≧80% rusting | Δ | X | XX | 50% rusting | D |
| 5 | 30% rusting | ○ | Δ | X | spot rusting | C |
| 6 | 20% rusting | ◎ | ○ | X | a sign of rusting | D |
| 7 | ≧80% rusting | Δ | X | XX | spot rusting | D |
| 8 | 20% rusting | ◎ | ○ | X | a sign of rusting | C |
| 9 | ≧80% rusting | Δ | X | XX | spot rusting | D |
| not added | 100% rusting immediately | X | XX | XX | 100% rusting | E |

TABLE 4

| experimental amine type antifreezing solution employed in anticorrosive test | |
|---|---|
| component | formulated amount (%) |
| MBT-Na | 0.28 |
| ortho-phosphoric acid | 0.41 |
| sodium nitrate | 0.14 |
| benzotriazole | 0.01 |
| triethanolamine | 1.93 |
| diethanolamine | 1.22 |
| water | 4.15 |
| ethyleneglycol | 92.00 |

TABLE 5 anticorrosive test of experimental amine type antifreezing solution (88 ± 2° C. × 336 hrs)

| | added | change of mass of steel specimen (mg/cm²) | | | | | |
|---|---|---|---|---|---|---|---|
| | amount (%) | aluminum | cast iron | copper | brass | solder | copper |
| present invention | | | | | | | |
| 1 | 0.01 | −0.02 | −0.01 | −0.01 | −0.02 | −0.02 | −0.01 |
| 2 | 0.01 | −0.01 | −0.01 | −0.01 | −0.02 | −0.02 | −0.01 |
| 3 | 0.01 | −0.02 | −0.01 | −0.01 | −0.02 | −0.01 | −0.01 |
| 4 | 0.01 | −0.03 | −0.01 | −0.01 | −0.02 | −0.02 | −0.01 |
| 5 | 0.01 | −0.03 | −0.01 | −0.01 | −0.02 | −0.01 | −0.01 |
| 6 | 0.01 | −0.03 | −0.02 | −0.01 | −0.03 | −0.02 | −0.01 |
| 7 | 0.01 | −0.02 | −0.01 | −0.01 | −0.03 | −0.02 | −0.01 |
| 8 | 0.01 | −0.02 | −0.01 | −0.01 | −0.02 | −0.01 | −0.01 |
| 9 | 0.01 | −0.02 | −0.02 | −0.01 | −0.02 | −0.02 | −0.01 |
| 10 | 0.01 | −0.03 | −0.01 | −0.01 | −0.03 | −0.03 | −0.01 |
| 11 | 0.01 | −0.03 | −0.01 | −0.01 | −0.02 | −0.02 | −0.01 |
| 12 | 0.01 | −0.02 | −0.01 | −0.01 | −0.01 | −0.02 | −0.01 |
| 13 | 0.01 | −0.03 | −0.02 | −0.02 | −0.02 | −0.03 | −0.01 |
| 14 | 0.01 | −0.02 | −0.01 | −0.00 | −0.01 | −0.02 | −0.01 |
| 15 | 0.01 | −0.01 | −0.02 | −0.00 | −0.02 | −0.03 | −0.01 |
| comparative | | | | | | | |
| 1 | 0.3 | −0.06 | −0.03 | −0.02 | −0.05 | −0.08 | −0.02 |
| 3 | 0.2 | −0.12 | −0.02 | −0.03 | −0.04 | −0.07 | −0.03 |
| 5 | 0.2 | −0.22 | −0.02 | −0.02 | −0.04 | −0.04 | −0.03 |
| 6 | 0.15 | −0.09 | −0.02 | −0.02 | −0.04 | −0.06 | −0.02 |
| 8 | 0.15 | −0.07 | −0.02 | −0.02 | −0.04 | −0.05 | −0.02 |
| 9 | 0.1 | −0.08 | −0.02 | −0.02 | −0.04 | −0.05 | −0.02 |
| not added | — | −0.32 | −0.42 | −0.11 | −0.09 | −0.22 | −0.05 |

TABLE 6 experimental non-amine type antifreezing solution employed in anticorrosive test

| component | formulated amount (%) |
|---|---|
| MBT-Na | 0.10 |
| ortho-phosphoric acid | 0.55 |
| sodium nitrate | 0.18 |
| sodium benzoate | 1.00 |
| sodium hydroxide | 0.44 |
| benzotriazole | 0.01 |
| water | 4.72 |
| ethyleneglycol | 92.00 |

TABLE 7 anticorrosive test of experimental non-amine type antifreezing solution (88 ± 2° C. × 336 hrs)

| | added | change of mass of steel specimen (mg/cm²) | | | | | |
|---|---|---|---|---|---|---|---|
| | amount (%) | aluminum | cast iron | copper | brass | solder | copper |
| present invention | | | | | | | |
| 16 | 0.05 | −0.03 | −0.05 | −0.02 | −0.04 | −0.07 | −0.02 |
| 17 | 0.05 | −0.03 | −0.04 | −0.02 | −0.04 | −0.08 | −0.02 |
| 18 | 0.05 | −0.03 | −0.05 | −0.02 | −0.05 | −0.08 | −0.02 |
| 19 | 0.05 | −0.03 | −0.05 | −0.02 | −0.05 | −0.06 | −0.02 |
| 20 | 0.05 | −0.03 | −0.04 | −0.02 | −0.05 | −0.06 | −0.02 |

TABLE 7-continued anticorrosive test of experimental non-amine type antifreezing solution (88 ± 2° C. × 336 hrs)

| | added | change of mass of steel specimen (mg/cm²) | | | | | |
|---|---|---|---|---|---|---|---|
| | amount (%) | aluminum | cast iron | copper | brass | solder | copper |
| 21 | 0.05 | −0.04 | −0.04 | −0.03 | −0.03 | −0.06 | −0.02 |
| 22 | 0.05 | −0.03 | −0.04 | −0.03 | −0.03 | −0.04 | −0.02 |
| 23 | 0.05 | −0.03 | −0.04 | −0.03 | −0.03 | −0.05 | −0.02 |
| 24 | 0.05 | −0.03 | −0.03 | −0.02 | −0.03 | −0.04 | −0.02 |
| 25 | 0.05 | −0.03 | −0.03 | −0.02 | −0.03 | −0.04 | −0.02 |
| comparative | | | | | | | |
| 2 | 0.5 | −0.10 | −0.33 | −0.09 | −0.11 | −0.24 | −0.04 |
| 4 | 0.5 | −0.22 | −0.35 | −0.12 | −0.09 | −0.26 | −0.03 |
| 7 | 0.3 | −0.09 | −0.12 | −0.08 | −0.08 | −0.12 | −0.03 |
| not added | — | −0.32 | −0.62 | −0.22 | −0.13 | −0.32 | −0.09 |

TABLE 8 change in color of copper specimen after 40° C. × 95 PHR × 168 hrs

| | |
|---|---|
| present invention No. | |
| 1 | no color change |
| 2 | " |
| 3 | " |
| 4 | " |
| 5 | " |
| 6 | " |
| 7 | " |
| 8 | " |
| 9 | " |
| 10 | " |
| 11 | " |
| 12 | " |
| 13 | " |
| 14 | " |
| 15 | " |
| 16 | slight change (slight stain, flow mark) |
| 17 | " |
| 18 | " |
| 19 | " |
| 20 | " |
| 21 | " |
| 22 | " |
| 23 | " |
| 24 | " |
| 25 | " |
| comparative No. | |
| 10 | no color change |
| 11 | " |
| 12 | slight change |
| 13 | " |
| 14 | slight change (slight stain, flow mark) |
| 15 | " |
| 16 | medium change |
| 17 | " |
| not added | significant change (partially blue-purple or black) |

TABLE 9

| present invention No. | appearance of filtrate after test | cobalt ion concentration |
|---|---|---|
| 1 | light yellow | 40 |
| 2 | " | 25 |
| 3 | " | 7 |
| 4 | " | 23 |
| 5 | " | 17 |
| 6 | " | 15 |
| 7 | " | 10 |
| 8 | " | 19 |
| 9 | " | 22 |
| 10 | " | 4 |
| 11 | " | 10 |
| 12 | " | 9 |
| 13 | " | 11 |
| 14 | " | 16 |
| 15 | " | 12 |
| 16 | " | 4 |
| 17 | " | 7 |
| 18 | " | 23 |
| 19 | " | 26 |
| 20 | " | 29 |
| 21 | " | 22 |
| 22 | " | 19 |
| 23 | " | 25 |
| 24 | " | 31 |
| 25 | " | 23 |
| 10 | red orange | 210 |
| 11 | light orange | 180 |
| 12 | " | 175 |
| 13 | " | 120 |
| 14 | " | 166 |
| 15 | red orange | 230 |
| 16 | " | 189 |
| 17 | " | 200 |
| not added | red orange | 360 |

What is claimed is:

1. A method for treating surface portions of a metal comprised of iron, copper, and alloys thereof to prevent corrosion thereof comprising the steps of:

(a) dissolving in water a carboxylic acid and at least one water soluble tetrazole compound of the formula:

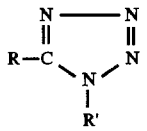

wherein R and R' are each independently selected from the group consisting of hydrogen, an alkyl group having 1 to 20 carbon atoms, a cycloalkyl group, a phenyl group, an alkylphenyl group, an amino group, a mercapto group, an alkylmercapto group and water soluble salts thereof, thereby to form an aqueous solution, and thereafter;

(b) contacting said surface portions of said metal with said solution.

2. The method of claim 1 wherein the amount of said tetrazole compound ranges from 0.01 to 20% by weight based on total weight of said composition.

3. The method of claim 1 wherein said carboxylic acid is sebacic acid.

4. The method of claim 1 wherein said solution additionally contains boric acid.

5. The method of claim 1 wherein said solution additionally contains a nitrogen-containing compound selected from the group consisting of triazoles, imidazoles, thiazoles, dialkanolamines and trialkanolamines.

6. The method of claim 1 wherein said solution additionally contains a surfactant selected from the group consisting of anionic surfactants and nonionic surfactants.

7. The method of claim 1 wherein said solution additionally contains an extreme pressure additive.

* * * * *

UNITED STATES PATENT AND TRADEMARK OFFICE

CERTIFICATE OF CORRECTION

PATENT NO. : 5,744,069
DATED : April 28, 1998
INVENTOR(S) : Akio Maeda and Makoto Kanekiyo It is certified that error appears in the above-indentified patent and that said Letters Patent is hereby corrected as shown below:

Line 4 of Abstract, insert --(-- before "wherein".
Column 5:
Column 2 of Table 1, No. 22, insert --)-- after "5(2-aminophenyl".
Column 9:
Column 1 of Table 9, line following "25" insert --comparative No.--.

Signed and Sealed this

Fifteenth Day of September, 1998

*Attest:*

Bruce Lehman

BRUCE LEHMAN

*Attesting Officer*

*Commissioner of Patents and Trademarks*